United States Patent [19]

Lin

[11] Patent Number: 4,891,995

[45] Date of Patent: Jan. 9, 1990

[54] TRIGGER CONTROL MEANS FOR MOVEABLE TOYS

[76] Inventor: Weng-Pin Lin, No. 30, Chien-Yung St., Taichung City, Taiwan

[21] Appl. No.: 181,491

[22] Filed: Apr. 14, 1988

[30] Foreign Application Priority Data

Aug. 20, 1987 [JP] Japan ..... 62-207339

[51] Int. Cl.[4] ..... G05G 17/00; A63H 11/10

[52] U.S. Cl. ..... 74/3.52; 185/39; 185/DIG. 1; 446/353; 446/435; 446/436

[58] Field of Search ..... 74/3.52; 185/37, 39, 185/DIG. 1; 446/435, 436, 353

[56] References Cited

U.S. PATENT DOCUMENTS 2,322,387 6/1943 Pitney ..... 74/3.52

3,131,508 5/1964 Brown ..... 446/436

4,382,347 5/1983 Murakami ..... 446/435 X 4,717,364 1/1988 Furukawa ..... 446/354 X

*Primary Examiner*—Allan D. Herrmann

*Attorney, Agent, or Firm*—Ladas & Parry

[57] ABSTRACT

This invention provides a moveable toy with a trigger control mechanism which has: a main body for defining the toy; a frame disposed within the main body; at least one acting means being able to reserve energy for generating an acting force and having a member for triggering the acting force; and a trigger control means installed in the frame and adapted to reserve energy for generating a rotating force by which the member of the above-mentioned acting means can be actuated and the acting force of the acting means can be triggered and released.

8 Claims, 7 Drawing Sheets

TRIGGER CONTROL MEANS FOR MOVEABLE TOYS

BACKGROUND OF THE INVENTION

The present invention relates to a trigger control means for moveable toys, and more particularly to a mechanical trigger control means which can trigger moveable toys to start their various actions.

Most moveable toys are actuated by the driving force of a coil spring, spiral spring or cell motor, which can manipulate only one or two simple actions rather than many actions, such as a forward, backward, or reciprocal movement, and/or a limited rotation. A moveable toy which can perform various actions is usually controlled by a complicated electric-circuit. The electric-circuit is not only too expensive to produce but also too difficult to operate safely; it is not fit for a child or even a youth, only an adult. A new mode of plastic model toy which is primarily driven by a plurality of springs has been provided. In addition to the above-mentioned movements and rotation, the toy can perform a number of actions by being actuated by the driving force of springs which are adapted to be separately and manually activated at any time or in any sequence. Whenever a certain button is pushed, the driving force reserved in a certain spring will be triggered and released to start a certain action.

Although the above-mentioned mechanically moveable toy which is driven by springs, cell motors or the like is cheap in cost and safe to operate, but it is difficult for a child to push a button disposed on a toy to trigger the driving force reserved in a spring when the toy is moving or carrying out another action.

SUMMARY OF THE INVENTION

Therefore, the object of the present invention is to provide a trigger control means for a moveable toy which is able to perform various actions, and which constitutes a mechanical structure and is adapted to automatically trigger the actions of the toy in sequence.

Firstly, the present invention provides a toy comprising: a main body for defining the toy; a frame disposed within the main body; at least one acting means being able to reserve energy for generating an acting force and having a member for triggering the acting force; and a trigger control means installed in the frame and adapted to reserve energy for generating a rotating force, by which the member of the above-mentioned acting means can be actuated and the acting force of the acting means can be triggered and released.

The above-mentioned toy is preferably a moveable toy, such as a toy car, which has a rotating means, such as a means comprised of wheels, said rotating means being actuated by the driving means installed in the above-mentioned trigger control means which can generate a rotating force via a gear train which is adapted to reduce and transmit the rotating force to the rotating means.

Secondly, the present invention further provides a trigger control means for the above-mentioned toy, comprising: at least one self-retrievable rocking arm having a fulcrum, a first end disposed in one side of the fulcrum which is adapted to actuate the member of the above-mentioned acting means when the rocking arm is rocked, and a second end disposed in the other side of the same; a cam means adapted to be driven by the rotating force transmitted via the gear train, which includes a rotatable cam drum having a cam surface adapted to rock the second end of the rocking arm when the cam drum is in a rotating state.

In addition, because the toy has a plurality of acting means, the trigger control means can be constructed to have a plurality of rocking arms, and the cam drum can be configured to have a cam surface which can rock the second ends of the plurality of rocking arms in a certain sequence when the cam drum is in a rotating state.

In the above-mentioned construction, while the primary action of the rotating means is actuated by the driving means, such as a spiral spring, the trigger control means of the present invention can simultaneously reduce the rotation speed of the rotating force supplied from the rotating means by its gear set, and transmit the speed-reduced force to the cam gear of its transmission means to rotate the cam gear for a certain angle and ascend the two-bar linkage from a folded state to a straight state by means of the relationship between the pin for pivoting the two bars of the linkage and the guiding channel formed on the cam gear so as to put the idle gear which is pivoted in the free end ft one of the bar to the position where the gear member of the cam drum and the output gear of the above-mentioned gear set can be engaged by means of the same . Then, by means of friction transmission, the cam drum can be rotated by the gear member at an appropriate speed. Further, by means of the tongues protruded from the cam drum, the rocking arms can be rocked in sequence, and in this way, the acting means can be intermittently triggered in sequence. When the cam drum has rotated a certain number of revolutions, one end of the cam drum, which is composed of a set of friction plates, will be braked, and the friction plate for driving the cam drum, which is engaged with the friction plate installed in the other end of the same, will slip off the engagement, because the input force is larger than the engagement for driving the cam drum and smaller than that for braking the same. Thus, the cam drum will be braked and the rotation will cease while the other actions of the toy are still carried out. In addition, when a rotating force which is larger than the engagement for braking the cam drum is applied to the same, the cam drum will slip off the engagement and be rotated. Therefore, the orientation of the cam drum can be changed and the triggering sequence of the trigger control means can be shifted. That is, a toy having the trigger control means installed therein can carry out various actions in a selected sequence which can be shifted.

BRIEF DESCRIPTION OF THE DRAWINGS

The present invention is illustrated by way of examples in the accompanying drawings, in which.

DETAILED DESCRIPTION OF THE INVENTION

Figure 1A:
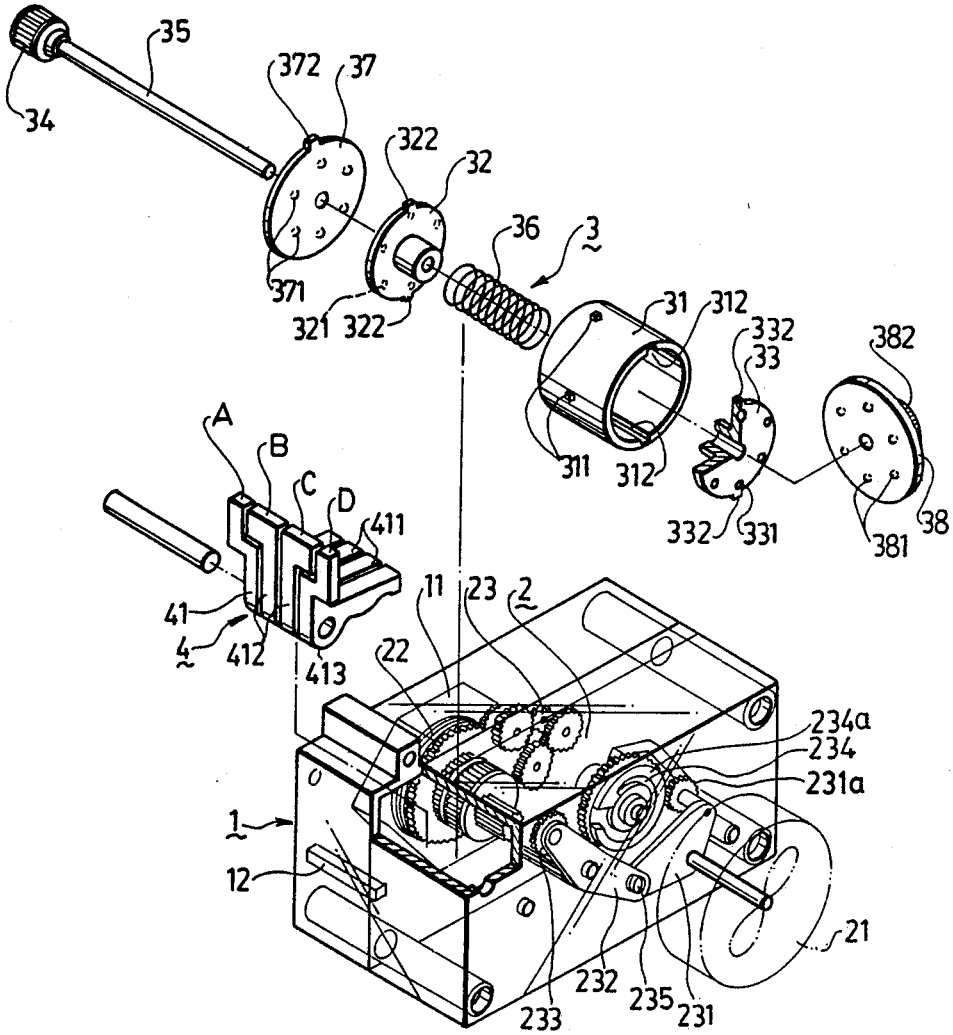
FIG. 1*a* is a perspective view of a preferred embodiment according to the present invention, wherein the main construction of the embodiment is shown by an enlarged and exploded view.
Figure 1B:
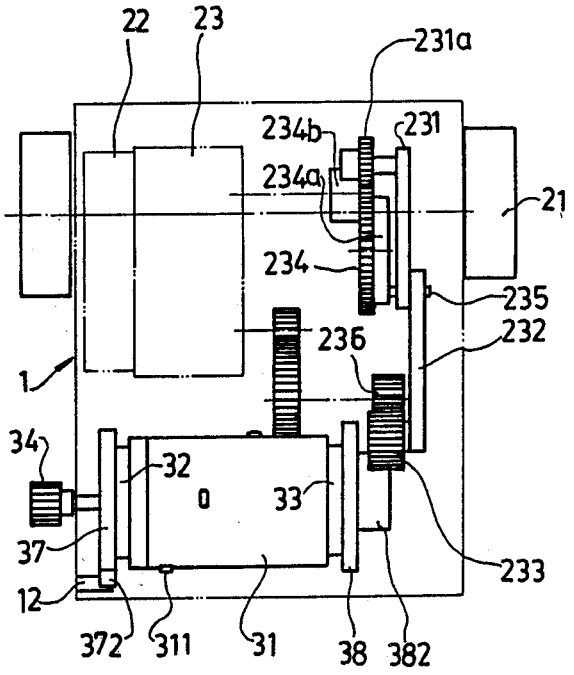
FIG. 1*b* is a plan view of the embodiment shown in FIG. 1*a;*

Referring to FIG. 1*a* and FIG. 1*b*, there is a frame 1 shaped as a housing. The frame 1 has a driving means 11 installed on one internal wall of it. Within the driving means 11, there is a spiral spring 22 installed. A transmission means 2 having an idle gear 233 and a gear set 23 are installed within the frame 1 extensively from the rear portion to the middle portion. The gear set 23 is adapted to receive the output of the driving means 11, to reduce the rotation speed of the output, to constantly transmit the output to the rotating means of a toy, such as the wheels of a toy car, and to output with a rotation speed which is appropriate to the trigger control means when the brake is released. The idle gear 233 is not adapted to be actuated immediately, instead, after a period, the transmission means 2 is started by the gear set 23. In addition, within the frame 1, there is a cam means 3 installed in the front side of the same. As shown in the top portion of FIG. 1*a*, the view of the cam means 3 is exploded and enlarged for the convenience of illustration. Above the cam means 3, there is a trigger means 4 constructed by four rocking arms 41, one end of each rocking arm 41 is in contact with the cam drum 31 of the cam means 3. The spiral spring 22 is adapted to be wound up by a rotatable member 21, such as a thumb handle or a wheel of a toy car.

The gear set 23 is composed of a series of gears, the construction of which may be generally conventional, but as stated hereinbefore, which must be adapted to receive the output of the spiral spring 11, to constantly transmit the output with an appropriate rotation speed, to the rotating means of a toy, such as the wheels of a toy car, and to drive the transmission means 2 and the cam means 3 with an appropriate speed.

Figure 2:
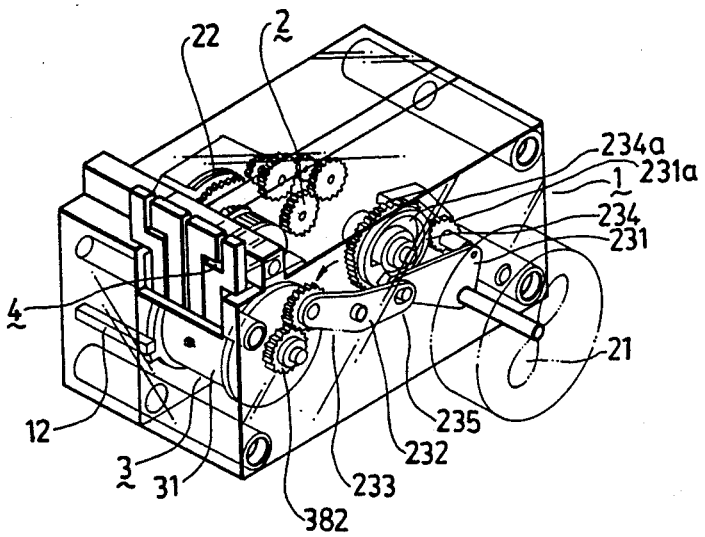
FIG. 2 is an assembled view of the embodiment shown in FIG. 1*a;*

The transmission means 2 comprises a cam gear 234 for receiving and lagging the rotating force supplied via a pinion 234*b* which is coupled in an output shaft of the gear set 23. On one side cf the cam gear 234, there is a guiding channel 234*a* shaped along the periphery as an opened annulus, one end of which is opened and the other is closed. The transmission means 2 further comprises a two-bar linkage constructed by links 231, 232 which are rotatably and slidably linked together via a long slot by a pin 235. The link 231 is further rotatably borne by the same axle with which the rotating means 21 is borne. In the other end of the link 232 the above-mentioned idle gear 233 is pivoted, and, in addition, the middle point of the link 232 is further pivoted in the frame 1. Although it is not shown in the figures, the pin 235 is made of a flexible material, the internal end of which is adapted to press the periphery of the cam gear 234 and to enter the guiding channel 234*a*. Usually, the two-bar linkage is in folded state, as shown in FIG. 1*a*. When the cam gear 234 is rotated by the pinion 234*b*, the pin 235 will enter at the opened end of the guiding channel 234*a* and relatively move along the same, then finally be pushed upwardly by the closed end of the same to the upper position in which the two-bar linkage will be in straight state as shown in FIG. 2. In this way, the idle gear 233 will be moved to the cam means 3. In addition, the free end of the link 231 has an idle gear 231*a* pivoted therein by means of a pin. The idle gear 231*a* usually engages with the pinion 234*b* and the cam gear 234, and transmits the rotation which is transmitted from the gear set 23. Thusly, as the end pivoted with the link 232 is rotated, the gears 234 and 234*b* will be disengaged.

In respect to the cam means 3 disposed in the front side of the frame 1, it comprises a shaft 35, the free end of which has a thumb knob 34 fixed therein. Fitted along the shaft 35, there is a hollow, cylinderical cam drum 31, friction plates 32, 33 respectively disposed in the sides of the cam-drum 31, which are axially slidably fitted with the same, a friction plate 37 for braking the cam-drum 31, which is frictionally fitted with the friction plate 32, and a friction plate 38 for driving the cam-drum 31, which is frictionally fitted with the friction plate 33. On the external surface of the cam drum 31, there are four protruding tongues 311 formed apart with angular intervals. In this embodiment, the axial intervals of the tongues 311 are equal, but they are not limited by that. The internal surface of the cam drum 31 has splines 312 formed thereon. In addition, there are protrusions 322, 332 respectively formed in the periphery of the friction plates 32, 33, which are slidably inserted into the splines 312. Within the cam drum 31, an extension spring 36 is further installed between the friction plates 32, 33, causing the friction plates 32, 33 to be pressed outwardly. The outward walls of the friction plates 32, 33 respectively have spherical protrusions 321 and 331 for engaging with the spherical concaves 371, 381 correspondly formed on the inward walls of the friction plates 37, 38. In this embodiment, the heights of the protrusions 321 and the concaves 371 respectively formed on the friction plates 32 and 37 are about 0.8 mm, and the height of the protrusions 331 and the concaves 382 are about 0.4 mm. The friction plate 32 is fixed in the shaft 35 so as to be rotated by means of the thumb knob 34. Further, a lug 372 is radially formed in the periphery of the friction plate 37 so that the rotation can be ceased in every round by a stopper 12 protruded from the frame 1, which is disposed in a position which can block the rotating of the lug 372. Additionally, there is a gear member 382 formed in the other side of the friction plate 38 which is frictionally fitted with the friction plate 33 for driving the cam drum. When the idle gear 233 pivoted in the free end of the link 232 is moved into the gap between the gear member 382 and an output gear 236 of the above-mentioned gear set 23, and engaged with them, the cam-drum 31 will be rotated.

The trigger means 4 is composed of four L-shaped rocking arms 41( hereinafter the actuating ends of them will be referred to as A, B, C, D ) the elbow portions of which are pivoted in series in the frame 1 by means of a pin. One portion 412 of each arm ( hereinafter referred to as first portion ) is adapted to actuate a member of acting means ( not shown ), and the other portion 411 (hereinafter referred to as second portions) makes contact with the external surface of the cam-drum 31. In this way, a first portion 412 will be rocked counterclockwise when the corresponding second portion 411 is pushed by a tongue 311 formed on the rotating cam drum 31.

The operation of the embodiment will be illustrated hereunder.

When the spiral spring 22 is wound by rotating the rotating means 21, the link 231 will be rotated counterclockwise and the idle gear 231*a* will be engaged with the cam gear 234 and the pinion 234*b* so as to transmit the rotation of the gear set 23. On the other hand, the link 232 will be rotated clockwise and the idle gear 233 will be disengaged from the gear member 382 and the gear 236. The protruded end of the pin 235 will simultaneously escape from the guiding channel 234*a* via the opened end of the same. Thusly, the ends of the links 231, 232, which are mutually pivoted together, wil1 descend to the lower position folded as shown in FIG. 1*a*.

When the rotating force of the spiral spring 22 is emitted via the gear set 23, the primary action, such as rotating the wheels of a toy car, will be carried out and the car will be moved. As the toy car is in moving state, the rotating force of the spiral spring 22 will be transmitted via the gear set 23, and its rotation speed will be reduced by the same. In this way, the pinion 234*b* wil1 be rotated so that the cam gear 234 will then be rotated by means of the idle gear 231*a*. The overall output of the spiral spring 22 and the reduction ratio of the gear set 3 are preferably that the cam gear 234 will be rotated about one round when the primary action has carried out one stroke. According to the above-mentioned action mode, the rotation speed of the pinion 234*b* and the output speed of the gear 236 can be selected appropriately.

As the cam gear 234 is in a rotating state, the pin 235, by which the links 231, 232 are rotatably borne together therein, will enter at the opened end of the guiding channel 234*a* and then will be upwardly pushed by the closed end of the same so that the two-bar linkage can ascend to the upper position in which the links 231, 232 are in unfolded state. In this way, the idle gear 231*a* will be moved to the state in which the rotating force of the gear set 23 can not be transmitted and the rotation of the cam gear 231*a* will cease. As to the idle gear 233 in the other end of the linkage, it will descend to the engaged state by which the gear member 382 of the cam means 3 can be rotated by means of the gear 236.

The input of the gear member 382 will then be transmitted to the friction plate 38 and rotate the same so that the cam drum 31 will be rotated by means of the friction plate 33 which is frictionally fitted with the friction plate 38 by the engagement between the protrusions 331 and the concaves 381 and also simultaneously rotated with the same. When the cam drum 31 is in a rotating state, the tongues 311 formed thereon will be moved along their circumferential orbit and respectively rock the corresponding arms 41 by pushing the second portions 411 of the same in sequence so that the members for triggering the acting means, such as the buttons for triggering various actions of a toy, will be actuated in sequence by the first ends 412 of the arms 41.

Figure 4:
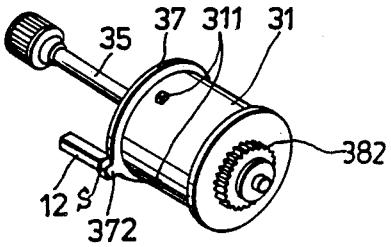
FIG. 4 and FIG. 5 are views respectively showing the orientation of the stopper 12 before and after the rotation of the cam drum 31.
Figure 5:
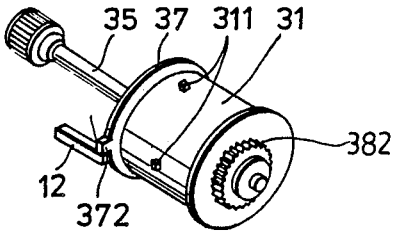

When the cam drum 31 is rotated one round and the actions are all finished, the lug 372 protruded from the friction plate 37, which is frictionally fitted with the friction plate 32 by the engagement between the protrusions 321 and the concaves 371, wil1 be rotated from the position S where it is disposed under the stopper 12, as shown in FIG. 4, to the position E in which it is disposed above the same, as shown in FIG. 5, and stopped by the stopper 12. However, by that time, the rotating force is transmitted via the gear member 382 to the friction plate 38. In this way, the friction plate 38 will escape from the engagement formed between the protrusions 381 and the concaves 331 which respectively have the height of 0.5 mm, because upon the same compression force of the spring 36, the engagement is far weaker than that formed between the protrusions 321 of the friction plate 32 and the concaves 371 of the friction plate 37 which respectively have the height of 0.8 mm.

It is worthy of note that the relative position of the cam drum 31 can be regulated by means of the thumb knob 34. When the thumb knob 34 is rotated, the friction plate 32 will slip o±f the engagement formed between the protrusions 321 and the concaves 371, because the lug 372 of the friction plate 37 is blocked by the stopper 12. In this way, the triggering sequence of the rocking arms 41 which is actuated by the tongues 311 formed on the cam-drum 31 can be shifted, such as from A, B, C, D to B, C, D, A or C, D, A, B . . . etc.

In addition, the lug 372 of the friction plate 37 can be rotated opposite to the position S shown in FIG. 4 by means of a transmission means which can be actuated by the rotating means 21. Of course, any means which can be actuated via the shaft 35 by rotating the thumb knob 34 is also preferred.

Figure 3:
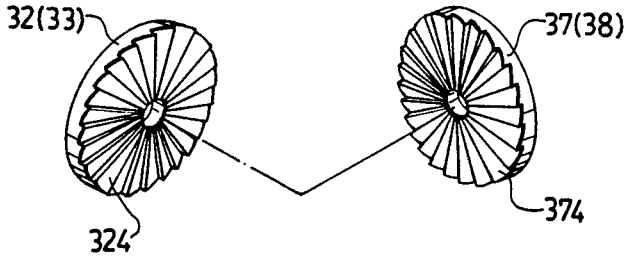
FIG. 3 is an enlarged view illustrating another exemplary relationship between the friction plates 32–37 or 33–38 shown in FIG. 1*a;*

FIG. 3 shows an enlarged view illustrating another exemplary relationship between the friction plates 32–37 or 33–38. As shown in the figure, one of the friction plates 32 or 33 has one-way gear teeth 324 radially formed thereon, and the other 37 or 38 has the same teeth 374 formed thereon except that they are formed in an opposite circumferential direction, so that the gears can be engagingly moved together in one way because the friction plates 32, 33 are outwardly compressed by the spring 36.

Figure 6:
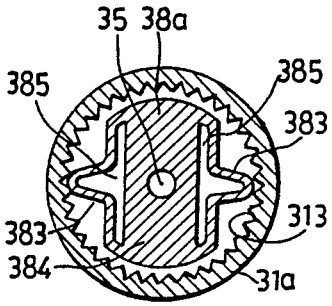
FIG. 6 is an enlarged sectional view illustrating another exemplary construction for driving the cam-drum 31.

FIG. 6 shows an enlarged sectional view illustrating another exemplary construction for driving the cam drum. As shown in the figure, inside the opened end there are internal gear teeth 313 formed on the internal peripheral wall of the cam drum 31*a*. In addition, there is a plate 38*a* for driving the cam drum 31, which has a gear member 382 formed on one side and an insert 38 formed on the other side the insert being installed inside the cam drum 31*a* and having a pair of claws 383, 383 flexibly protruded from its periphery and engaged with the gear teeth 313. The plate for braking the cam drum 31 can also be made to be of the same construction which can carry out the same performance as that of the above-mentioned embodiment. In the figure, the numerals 385, 385 are marked for the cavities of the claws 383, 383 which are formed for increasing the flexibility of them.

Figure 7:
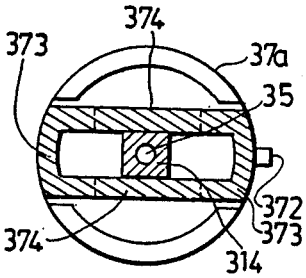
FIG. 7 is an enlarged partially sectional view illustrating another exemplary construction for transiting the trigger sequence of the cam drum, wherein the portion adjacent to the friction plate 37 is also shown.

In addition, the plate 37*a* for braking the cam drum 31 can also be constructed to resemble the structure shown in FIG. 7. As shown in the figure, the cam drum 31 has an end plate with a square-shaped neck 317 sleeved around the shaft 35. There are a pair of parallel ribs 374, 374 flexibly formed on the corresponding side of the plate 37*a*, by which the neck 314 can be engaged therebetween. Thusly, the plate 37*a* can be rotated and stopped simultaneously with the cam drum 31. However, when the thumb knob 34 is strongly rotated as the lug 372 formed in the periphery of the plate 37*a* is blocked by the stopper 12, the ribs 374, 374 will be deformed by the torsional force of the square neck 314 and pushed out from the frames 373. In this way, the cam drum 31 can be rotated by means of the thumb knob 34 while the plate 37*a* is stopped by the stopper 12. That is, the relative orientation of the cam drum 31 can be regulated, and the sequence of the trigger means 4, which is actuated by the tongues 311 protruding from the cam drum 31, can be shifted by rotating the thumb knob 34.

Hereinafter, several exemplary toys using the trigger control means wil1 be illustrated.

Figure 8:
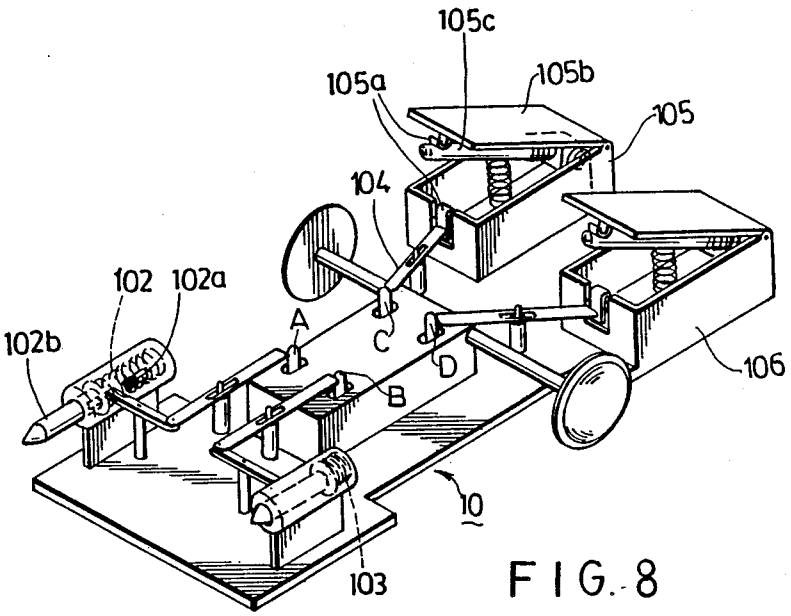
FIG. 8 and FIGS. 9A, 9B, and 9C are perspective views illustrating the operational relationships of two exemplary moveable toys used in the above-mentioned embodiment.

FIG. 8 shows a toy trailer 10 which has missile apparatuses 102, 103, 105, 106 respectively installed in its four corners. The four members for triggering the four missile apparatuses 102, 103, 105, 106 are adapted to make contact with the four actuating ends A, B, C, D of the rocking arms 41. Therefore, they can be controllably triggered by the trigger control means according to the present invention.

Figure 9A:
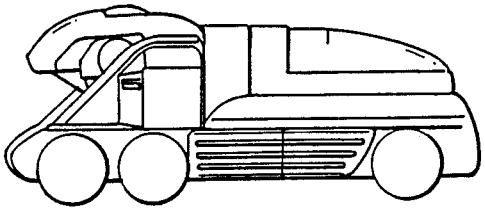
Figure 9B:
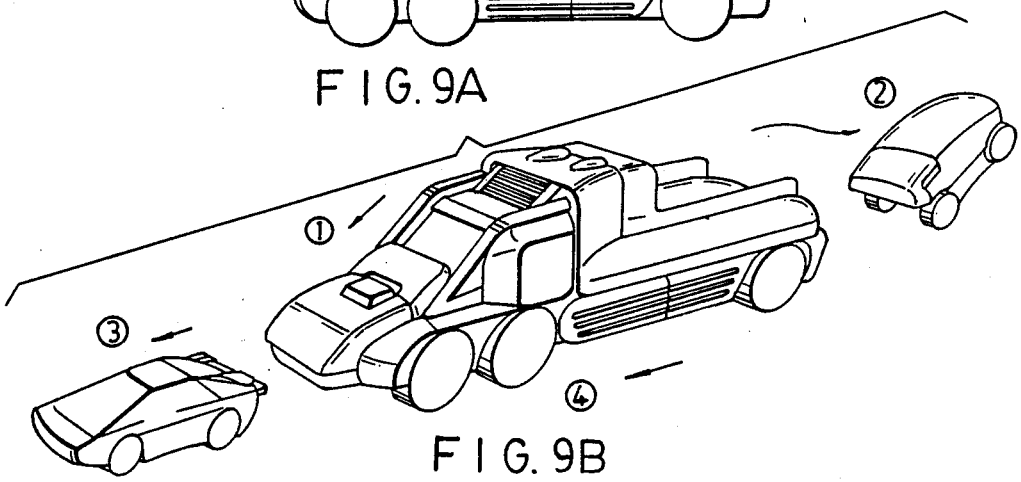
Figure 9C:
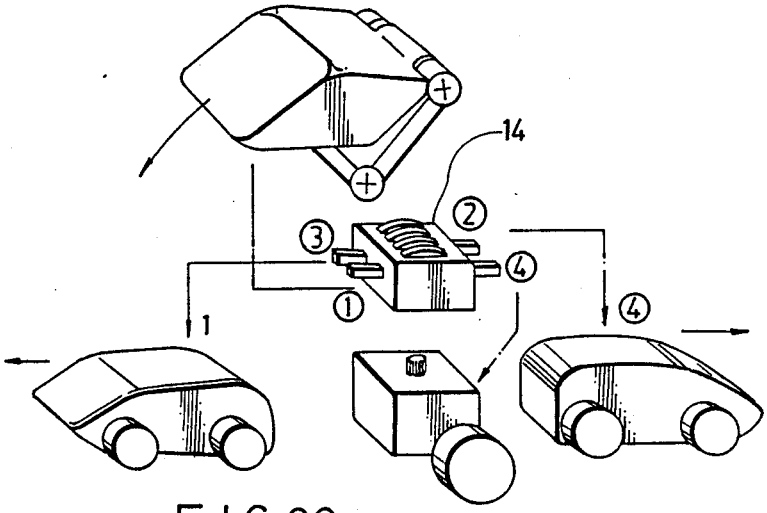
Figure 10A:
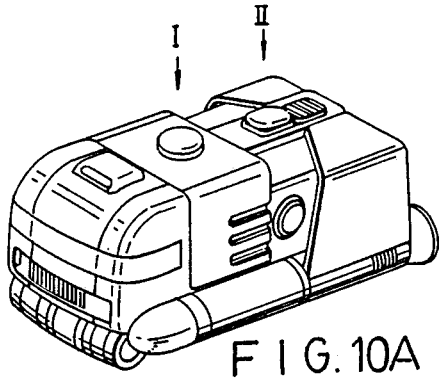
FIGS. 10A, 10B and 10C and FIGS. 11A, 11B and 11C are perspective views of two examples for illustrating the performance of moveable toys which have two trigger control means installed therein.
Figure 10B:
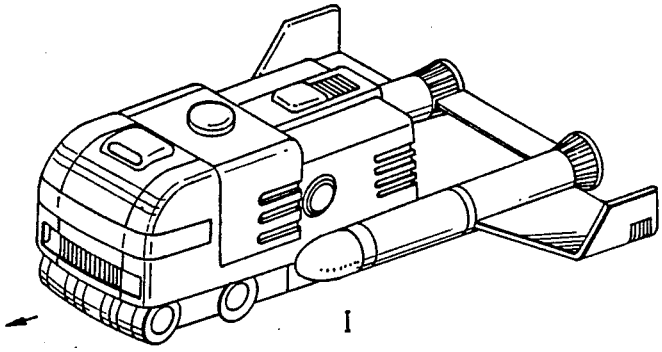
Figure 10C:
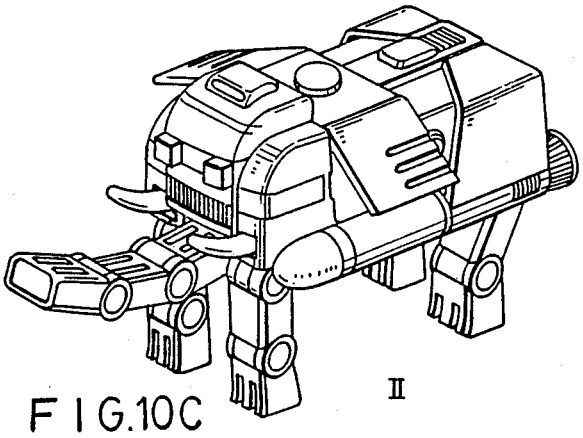
Figure 11A:
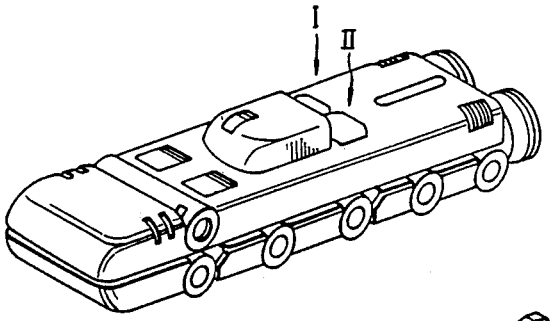
Figure 11B:
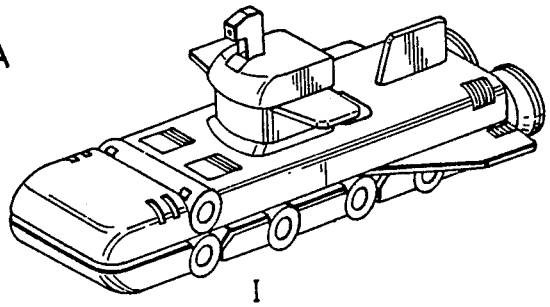
Figure 11C:
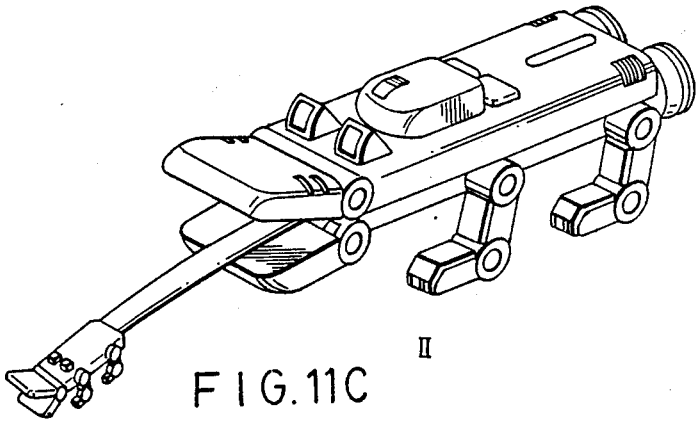

FIGS. 9A, 9B and 9C show a toy car which is composed of a parent car and two child cars. By means of the trigger control means 14, first, the child car disposed in the top portion of the parent car will be descended to the front portion, second, the other child car disposed in the rear portion will be ejected, third, the one now descended in the front portion will be ejected, then, the parent car itself will be moved forwardly. The numerals marked in the figure show the acting procedures mentioned hereinbefore.

FIGS. 10A, 10B and 10C and 11A, 11B and 11C respectively show the action series of exemplary toys which are controllably triggered by two sets of the trigger control means according to the present invention. For example, when the button I is pushed, the toy will be moved and its shape will be changed, and then, when the button II is pushed, the legs of the toy will be extended and the toy will be moved by the same.

As shown in the above-mentioned embodiment, the trigger control means of the present invention can reduce the rotation speed of the rotating force supplied from a rotating means, such as a spiral spring, by its gear set, and transmit the speed-reduced force to its cam gear to raise the two- bar linkage from a folded state to a straight state by means of the relationship between the pin for pivoting the two bars of the linkage and the guiding channel formed on the cam gear. Then, by means of the friction transmission, the cam drum can be rotated while the cam gear is stopped. Further, by means of the tongues protruded from the cam drum, the rocking arms can be rocked in sequence. In this way, the acting means can be controllably triggered in sequence. That is, a moveable toy having a trigger control means installed therein can controllably trigger its acting means by means of such a mechanical construction.

While the invention has been described in connection with what is presently considered to be the most practical and preferred embodiment, it is to be understood that the invention is not to be limited to the disclosed embodiment, but, on the contrary, is intended to cover various modifications and equivalent arrangements included within the spirit and scope of the broadest interpretation so as to encompass all such modifications and equivalent arrangements.

I claim:

1. A toy comprising:

acting means for generating an acting force, said acting means having a member for triggering the acting force;

rotating means adapted to be driven by a rotating force for carrying out a primary action;

at least one rocking arm having a first end and a second end;

a rotatable can drum with an exterior cam surface;

tongues disposed on said cam surface, so that as said cam drum is rotated causing a tongue to urge against said second end of said rocking arm, said first end is caused to rock and thereby actuate said acting means; and a gear train for reducing and transmitting the rotating force to said rotating means.

2. A toy comprising:

a frame disposed within a main body;

at least one acting means (102) biased to store energy for generating an acting force and having a member (102*a*) for triggering the acting force;

trigger control means (3,4) installed in said frame, said trigger control means comprising:

at least one self-retrievable rocking arm (41) having a fulcrum (413), a first end (412) disposed in one side of the fulcrum (413) which is adapted to actuate the member (102*a*) when the rocking arm (41) is rocked, and a second end (411) disposed on the other side of the fulcrum (413);

cam means (3) adapted to be driven by the rotating force, said cam means comprising a rotatable cam drum (31) having an exterior surface with means for rocking the second end (411) of the rocking arm (41) when the cam drum (31) is in a rotating state, wherein said trigger control means is adapted to reserve energy for generating a rotating force, by which the member can be actuated and the acting force of said acting means can be triggered and released;

rotating means (21) which is adapted to be driven by the rotating force for carrying out a primary action; and a gear train (2) adapted to reduce and transmit the rotating force from said trigger control means (3,4) to said rotating means (21).

3. A toy as claimed in claim 2, wherein the toy has a plurality of acting means, and the trigger control means has a plurality of rocking arms, further, the cam-drum is configured to have a cam surface which can rock the second ends of the plurality of rocking arms in a certain sequence when the cam drum is in a rotating state.

4. A toy as claimed in claim 3, wherein the cam drum is shaped as a hollow cylinder having two ends, in addition to the cam drum the cam means further comprises: a rotating shaft installed along the axial line of the cam drum and passing through the same; a first friction plate axially slidably fixed in one end of the same; a second friction plate axially slidably fixed in the other end of the same; an extension spring installed inside the same, which is adapted to outwardly push the first and second friction plates; a plate for driving the same, one side of which is frictionally engaged with the first friction plate, and the other side of which has a gear member formed thereon; a plate for braking the same, one side of which is frictionally engaged with the second friction plate, and the periphery of which has a lug protruded therefrom; and a stopper protruded from the frame, which is adapted to block the rotating orbit of the lug.

5. A toy as claimed in claim 4, wherein the shaft is adapted to extend to the outside of the main body and the second friction plate is adapted to be manually rotated by means of the shaft from the outside of the same, in addition, the engagement between the plate for braking the cam drum and the second friction plate is stronger than the engagement between the plate for driving the cam drum and the first friction plate.

6. A toy as claimed in claim 3, wherein the cam drum is shaped as a hollow cylinder and has at least one opened end, inside which has internal gear teeth formed on the peripheral wall of it; in addition to the cam drum, the cam means further comprises a plate for driving the cam-drum, which comprises a gear member formed on one side and an insert formed on the other side, the insert being inserted inside the cam drum and having a pair of claws flexibly protruded from its periphery and engaged with the gear teeth.

7. A toy as claimed in claim 3, wherein the cam drum is shaped as a cylinder having two ends, in addition to the cam drum, the cam means further comprises a rotating shaft installed along the axial line of the cam drum and passing through the same, a square-shaped neck formed on one end of the cam drum and sleeved around the rotating shaft, and a plate for braking the cam drum having a pair of parallel ribs flexibly formed on its one side, which are adapted to limitarily engage the square-shaped neck between them.

8. A toy as claimed in claim 3, wherein the gear train further comprises: a gear set for reducing the rotation speed of the rotating force and a transmission means for transmitting the speed-reduced force to the cam means; said transmission means comprising: an output gear which is adapted to be driven by the gear set; a two-bar linkage having two ends, and which has two links pivoted together by a pin; a cam gear adapted to vertically move the pin between one position in which the linkage is in a folded state and the other position in which the same is in a straight state; an idle gear pivoted in one end of the linkage, which is adapted to engage between the gear set and the cam gear for transmitting the rotating force to the cam gear when the linkage is in the folded state; and an idle gear pivoted in the other end of the linkage, which is adapted to engage between the output gear and the cam means for transmitting the rotating force to the cam means when the linkage is in the straight state.

* * * * *